United States Patent [19]

Koyama et al.

[11] 4,138,625

[45] Feb. 6, 1979

[54] HELIX TYPE TRAVELLING-WAVE TUBE AMPLIFIER

[75] Inventors: Kaoru Koyama; Tsutomu Kyuzaki; Toshimoto Kikuchi, all of Tokyo, Japan

[73] Assignee: Nippon Electric Co., Ltd., Japan

[21] Appl. No.: 818,570

[22] Filed: Jul. 25, 1977

[30] Foreign Application Priority Data

Jul. 26, 1976 [JP] Japan ..... 51-88864

[51] Int. Cl.[2] ..... H01J 25/34

[52] U.S. Cl. ..... 315/3.5; 315/37.53; 330/43; 333/76

[58] Field of Search ..... 315/3.5, 39.53; 333/33, 333/35, 76; 330/43, 56

[56] References Cited

U.S. PATENT DOCUMENTS

| | | | |
|---|---|---|---|
| 2,849,651 | 8/1958 | Robertson | 333/35 X |
| 2,896,178 | 7/1959 | Raisbeck | 333/35 X |
| 2,938,182 | 5/1960 | Dench | 333/33 X |
| 3,448,331 | 6/1969 | Cook | 315/39.53 |
| 3,600,711 | 8/1971 | Gerlack | 333/76 |
| 3,707,647 | 12/1972 | Rawls | 315/39.53 |

*Primary Examiner*—Saxfield Chatmon, Jr.
*Attorney, Agent, or Firm*—Ostrolenk, Faber, Gerb & Soffen

[57] ABSTRACT

A band-rejection filter which rejects harmonic components of the fundamental frequency of the output of a helix type travelling-wave tube is built into the connection of the output connection from the tube to its external circuit. A wide variety of specific filter structures are disclosed.

10 Claims, 13 Drawing Figures

HELIX TYPE TRAVELLING-WAVE TUBE AMPLIFIER

BACKGROUND OF THE INVENTION

This invention relates to travelling-wave tube amplifiers, and more specifically relates to the use of a rejective type filter for connecting a helix type tube to its output circuit.

Helix type travelling-wave tubes generally have an excellent frequency response over a broad band, and are frequently used as power amplifier tubes in various types of AM and FM communication systems. In such travelling-wave tubes, there should be broad band impedance matching between the input and output sections of the tube and their respective external circuits. To meet this requirement, a coupling structure is employed at the input and output sections which directly connects the helix to the inner conductor of a coaxial feeder terminal. Travelling-wave tubes having this structure are disclosed, for example, in an article entitled THE DEVELOPMENT OF SATELLITE TRAVELLING-WAVE TUBES, published in the Journal of the British Interplanetary Society, Vol. 26, pp. 521–532 (1973). Since a travelling-wave tube is a non-linear amplifier, higher harmonic components are inevitably generated especially when it is used as an amplification-saturated amplifier for a frequency-modulated carrier wave. Therefore, in a microwave transmitter, a band-pass or low-pass filter is provided at the most appropriate point between the travelling-wave tube and its antenna to prevent interference due to the higher harmonics and to reduce radiation of the harmful higher harmonics. Such circuits are disclosed, for example, in an article by E. J. Drazy et al. entitled NETWORKS in The Bell System Technical Journal, September 1968 issue, Vol. 47, No. 7, pp. 1397–1422. While higher harmonic components can be entirely absorbed by a band-pass or low-pass filter of the perfectly absorptive type, these filters are large and expensive. Reflective type filters are commonly used, but a reflective type filter can cause transmission distortion depending upon the distance between the filter and the attenuator provided in the slow-wave structure of the travelling-wave tube, and further depending upon the relation between these filters and non-linear amplification characteristics of the travelling-wave tube.

BRIEF DESCRIPTION OF THE PRESENT INVENTION

It is one object of the present invention to provide a helix type travelling-wave tube that is free from the aforementioned transmission distortion caused by the higher harmonics.

In accordance with the present invention, a band-rejection filter is formed at the connection between the coaxial output terminal of the travelling-wave tube and the coaxial line coupled to the waveguide transducer. Thus, higher harmonics are effectively rejected without causing any transmission distortion and the filter structure is small and economical.

More particularly, in accordance with the invention, there is provided a helix type travelling-wave tube which has an electron gun for emitting and forming an electron beam, and a collector for receiving said electron beam. A helix slow-wave circuit is disposed between said electron gun and said collector and surrounds said electron beam for generating an electromagnetic wave around said electron beam as excited by a high frequency signal applied to the end of said helix slow-wave circuit closest to said electron gun. Said electron gun, collector and slow-wave circuit are contained within an evacuated envelope, and a coaxial input terminal and a coaxial output terminal, each consisting of an insulated inner and outer conductor are provided where the outer conductor of each terminal is hermetically mounted to said evacuated envelope. The inner conductor of each terminal is coupled to said slow-wave circuit. The coupling means connecting said coaxial output terminal to said travelling-wave tube forms a band-rejection filter which rejects a second harmonic of the fundamental frequency inherent to said travelling-wave tube from the signal components contained in said high frequency signal.

DETAILED DESCRIPTION OF THE DRAWINGS

Figure 1:
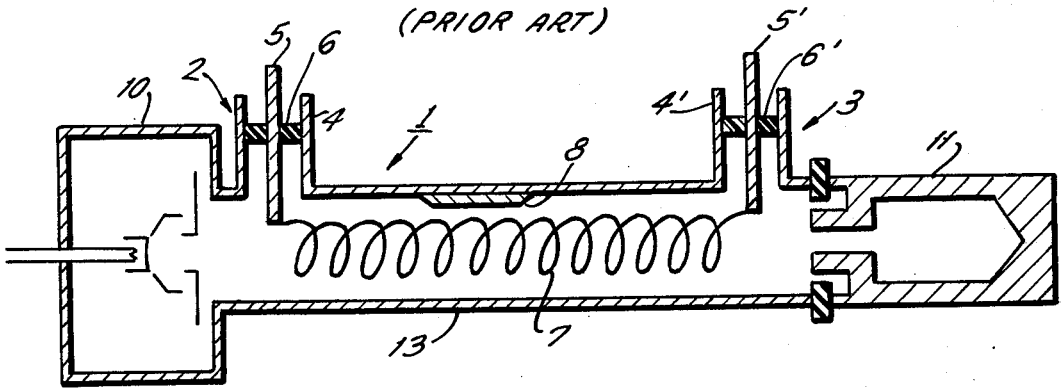
FIG. 1. (PRIOR ART)
FIG. 1 is a longitudinal cross-sectional view of a conventional helix type travelling-wave tube.

Referring first to FIG. 1, a prior art type travelling-wave tube 1 is shown which comprises an electron gun assembly 10 for emitting and forming an electron beam, a helix type slow-wave circuit 7 for effecting amplification, and a collector 11 for receiving the electron beam. The slow-wave circuit 7 is disposed within evacuated metallic envelope 13. An attenuator 8 is fixed within envelope 13 as shown. The end of the slow-wave circuit 7 closest to electron gun assembly 10 is connected to the inner conductor 5 of coaxial input terminal 2. The inner conductor 5 is hermetically fixed to an outer conductor 4 by an insulation member 6 made of alumina or beryllia, and the outer conductor 4 is hermetically mounted onto the envelope 13. The other end of the slow-wave circuit 7 closest to the collector 11 is connected to an inner conductor 5′ of coaxial output terminal 3. The coaxial output terminal 3 has the same structure as coaxial input terminal 2 and corresponding structural elements of coaxial terminals 2 and 3 are designated by like reference numerals. Suitable coaxial conductors or waveguide transducers are then normally suitably connected to the coaxial input and output terminals 2 and 3.

Figure 2:
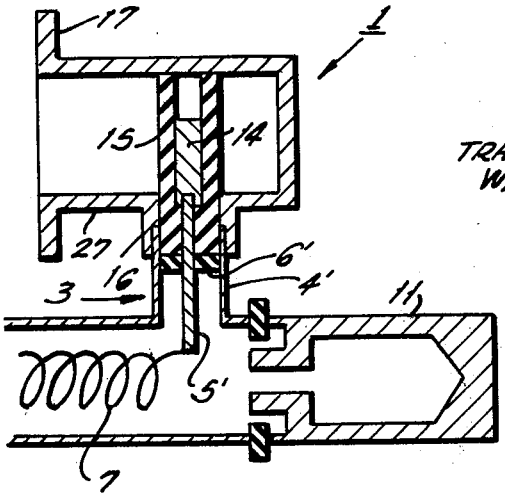
FIG. 2. (PRIOR ART)
FIG. 2 is a longitudinal cross-sectional view showing the connection of the output of the tube of FIG. 1 to a waveguide transducer.

FIG. 2 shows the connection of the output end 3 of the travelling-wave tube amplifier of FIG. 1 to a waveguide transducer 17. Waveguide transducer 17 consists of waveguide 27 having a cylindrical extension 16 protruding from its side wall. A hollow dielectric member 15 of polytetrafluoroethylene (TEFLON) is disposed coaxially with the extension 16, and a conductive probe member 14 is fixed within member 15. The inner diameter of the cylindrical extension 16, and the diameter and length of the inner conductor 5', are selected so that the waveguide transducer 17 may be mounted or plugged onto the coaxial output terminal 3 by a slide-fit such that, when the terminal 3 is connected to waveguide 17, the tip of the inner conductor 5' extends through the central opening in dielectric member 15 and contacts metallic member 14. The structure of FIG. 2 forms a transducer which passes not only the fundamental frequency component (f) of the amplified wave but also its higher harmonic components (2f, 3f . . . ) which are generated when the high frequency signal having a frequency f is amplified by the slow-wave circuit 7.

Figure 3:
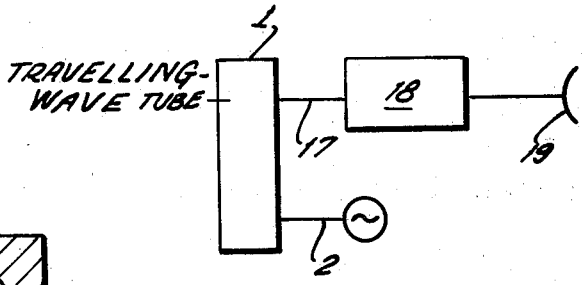
FIG. 3. (PRIOR ART)
FIG. 3 is a block diagram of a conventional microwave transmitter employing the travelling-wave tube of FIG. 1.
Figure 4A:
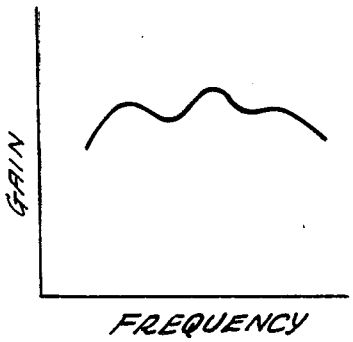
FIG. 4a. (PRIOR ART)
FIG. 4*a* shows the frequency response characteristics of the conventional travelling-wave tube of FIG. 1.
Figure 4B:
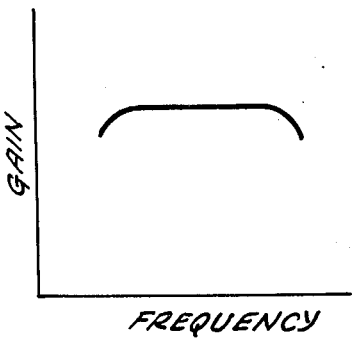
FIG. 4*b* shows the frequency response characteristics of a travelling-wave tube made in accordance with the present invention.

In one conventional structure and as shown in FIG. 3, a reflective type low-pass or band-pass filter 18 is provided between the waveguide transducer 17 of the travelling-wave tube 1 and the antenna 19 to reflect the higher harmonic components back to the travelling-wave tube 1. The higher harmonic components reflected back to the travelling-wave tube pass through the coaxial inner conductor 5' to the helix slow-wave circuit 7 to reach the attenuator 8 (FIG. 1) provided near the middle of the slow-wave circuit 7 for stabilizing the operation of the travelling-wave tube. While most of the higher harmonic components are absorbed by attenuator 8, some are reflected by the attenuator 8, amplified by the helix slow-wave circuit 7, and again passed through the output section coaxial feeder terminal 3 to the waveguide transducer 17 and then to the reflective type filter 18 where they are again reflected. As a result, many different higher harmonic and fundamental waves having different phase relations will exist between the attenuator 8 and the reflective low-pass or band-pass filter 18 in FIG. 3. Although the existence of the higher harmonics does not, by itself, cause transmission distortion, a large number of coupled waves are generated by interference between the fundamental wave and the higher harmonics, by interference between the different higher harmonics themselves due to non-linearity of the travelling-wave tube, and coupled waves having the same frequency as the fundamental frequency are superimposed on the original fundamental wave, thereby to cause both amplitude distortion and phase distortion of the transmitted signal. FIG. 4*a* shows one example of such transmission distortion.

Figure 5:
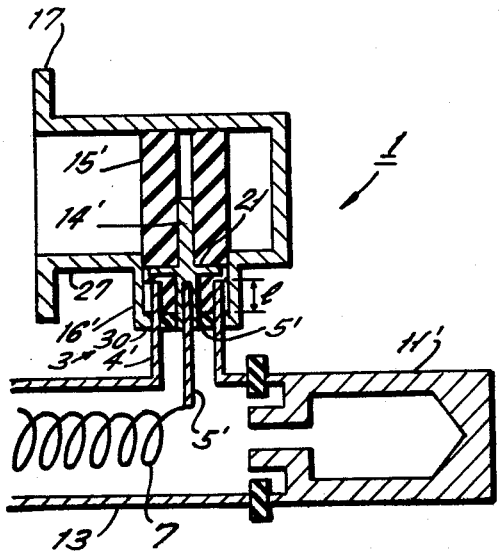
FIG. 5 is a longitudinal cross-sectional view of a first embodiment of the present invention.

FIG. 5 shows a first embodiment of the invention, in which a rejection filter is formed at the connection between waveguide transducer 17 and terminal 3. In all other respects, tube 1 is like that of FIG. 1. In FIG. 5, metallic member 14' to be brought into contact with inner conductor 5' of output terminal 3 and hollow cylindrical extension 16' are different from the corresponding members 14 and 16 in FIG. 2. Thus, one end of the hollow cylindrical member 16' is provided with an apertured circular end plate 30, and outer conductor 4' of the coaxial output terminal 3 extends through plate 30 and into extension 16'. The length l of the outer conductor 4' within the hollow cylindrical extension 16' is selected equal to about ¼ wavelength of the second harmonic of the fundamental frequency, to form a coaxial rejective filter for the second harmonic. The tip of the inner conductor 5' contacts the metallic member 14' and member 14' has a conductive disc plate 21 extending in a plane perpendicular to the axis of member 14'. The disc plate 21 comes close to the tip end of the outer conductor 4' and, therefore, impedance matching at the fundamental frequency (f) can be obtained by offsetting an inductance component of the coaxial rejective filter at the fundamental frequency (f). Also, in combination with this coaxial rejective filter, rejective filter characteristics which are effective for the higher harmonics generated in the travelling-wave tube can be provided. The dielectric member 15' employed for the purpose of impedance-matching the travelling-wave tube 1 with the external circuit and for structural reinforcement may be dispensed with if desired.

In the travelling-wave tube amplifier according to the embodiment of FIG. 5, the power component of the second harmonics can be reduced by 20 dB in comparison to the prior art structure.

Figure 6:
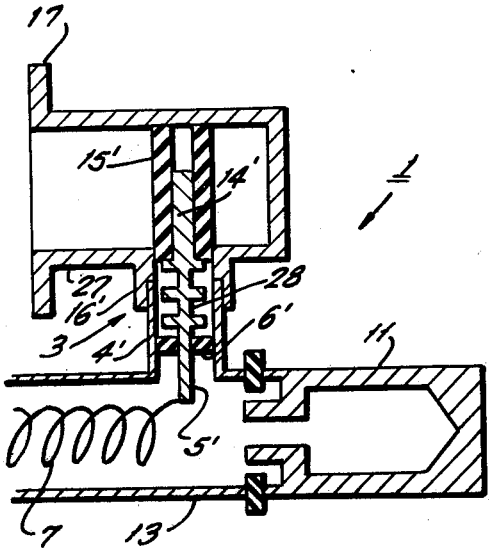
FIGS. 6, 7, 8, 9, 10, 11 and 12 are longitudinal cross-sectional views of second, third, fourth, fifth, sixth, seventh and eighth embodiments, respectively, of the present invention.

Referring next to FIG. 6, a second embodiment of the present invention is disclosed, where a conductor 28 has three disc plates coaxially mounted on its center rod portion. The disc plates are spaced at equal intervals selected so as to reject the second harmonic, and is disposed between inner conductor 5' of output terminal 3 and a metallic member 14' for exciting electromagnetic fields within a waveguide 27. Conductor 28 forms, jointly with an outer conductor 4' and a hollow cylindrical part 16', a coaxial low-pass line filter. This structure can reject not only the second harmonic but also higher order harmonics.

Figure 7:
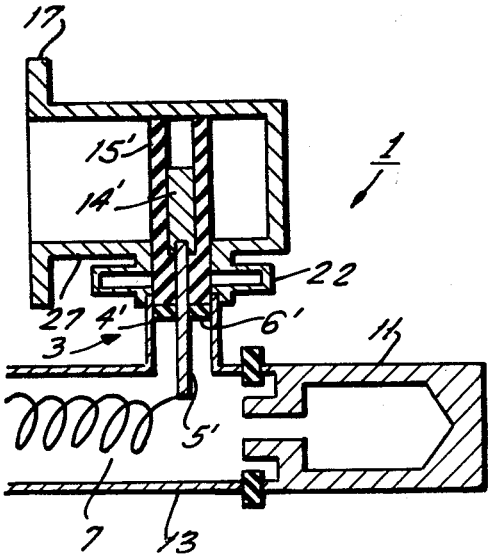

A third embodiment of the present invention is illustrated in FIG. 7 and has, as an integral part of the outer conductor 4' of output terminal 3, a hollow cylindrical section 22 of a larger inner diameter disposed coaxially with terminal 3 to form a radial-line coaxial filter. The resonant frequency of the radial-line coaxial filter is preset at twice the fundamental frequency, so that it can effectively reject the second harmonic. A radial-line coaxial filter is disclosed in an article by B. C. DeLoach, Jr. entitled RADIAL-LINE COAXIAL FILTERS IN THE MICROWAVE REGION published in IEEE TRANSACTIONS ON MICROWAVE THEORY AND TECHNIQUES, 1963 (January), pp. 50–55.

Figure 8:
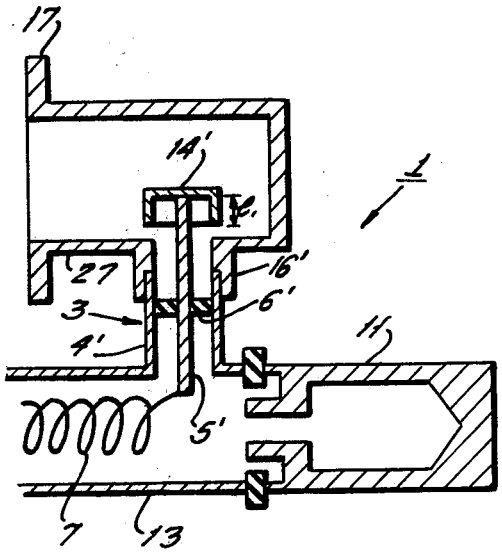

FIG. 8 shows a fourth embodiment of the invention, where the tip of the inner conductor 5' of the output terminal 3 is coaxially connected to the inner bottom surface of the cup-shaped metallic member 14'. The depth $l_1$ of the metallic member 14' is selected to be about ¼ wavelength at a frequency of twice the fundamental frequency, so that the second harmonic will be rejected.

Figure 9:
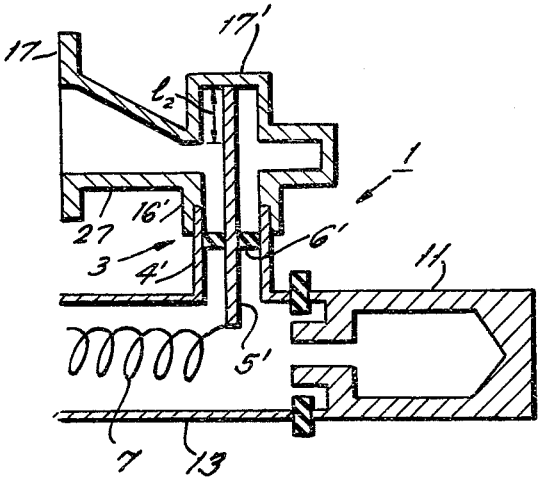

A fifth embodiment is illustrated in FIG. 9, where the tip of the inner conductor 5' is connected to the bottom of the circular recess 17' in the wall of the waveguide 27 at the point opposed to the wall portion where the hollow cylindrical member 16' is mounted. The depth $l_2$ of the recess 17' is fixed to satisfy the relation:

$$\tfrac{1}{4}\lambda < l_2 < \tfrac{1}{2}\lambda$$

where λ is the wavelength of the second harmonic. Thus, the inner conductor 5' and the hollow cylindrical part 16' are effectively short-circuited to each other for the second component, so that the second harmonic will be rejected.

Figure 10:
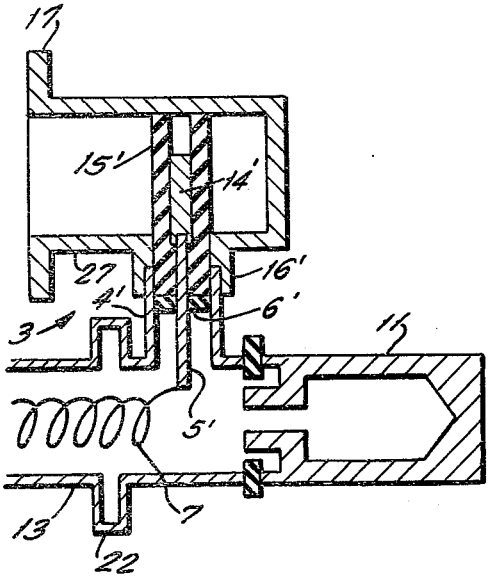

FIG. 10 shows a further embodiment of the present invention where the structure of the waveguide transducer 17 and the output terminal 3 is the same as the prior art structure shown in FIG. 2. In FIG. 10, however, a larger inner diameter section 22 is formed in the metallic envelope 13, thereby forming a radial coaxial line filter as in FIG. 7.

Figure 11:
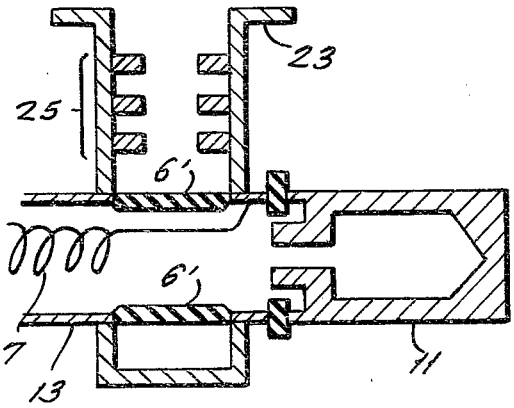

A seventh embodiment of the present invention is illustrated in FIG. 11 where the output section is formed in a waveguide structure rather than in the coaxial feeder terminal, and wherein the inside of the waveguide is shaped in a waffle-iron type filter structure 25. This type of low-pass filter has a broad rejective band and can attenuate the second and third harmonics by 30 dB or more. A waffle-iron filter is disclosed in an article by E. D. Sharp entitled a HIGH-POWER WIDE-BAND WAFFLE-IRON FILTER published in IEEE TRANSACTIONS ON MICROWAVE THEORY AND TECHNIQUES, 1963 (March), pp. 111–116.

Figure 12:
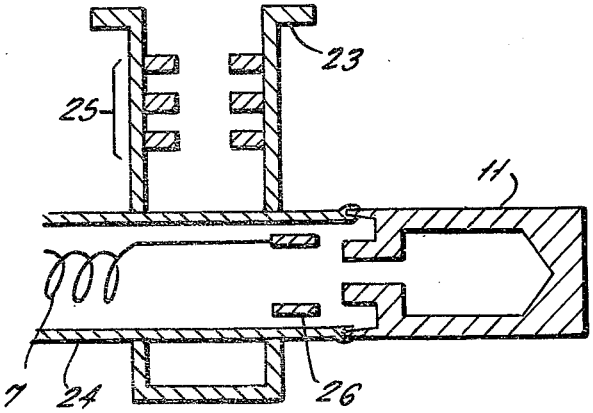

An eighth embodiment of the present invention is that shown in FIG. 12 and has a structure identical to that shown in FIG. 11, except that the envelope 24 is made of glass and the terminal end of the slow-wave circuit 7 is connected to the output section choke 26.

As described above and in accordance with the present invention, by providing a rejective filter between the output section of a helix type travelling-wave tube and its external circuit, higher harmonic components generated within the tube are reflected by the rejective filter to allow only the fundamental frequency component to be fed to the external circuit.

In general, transmsision distortion depends upon the distance between the filter 18 and the attenuator 8 as described with reference to FIGS. 1 and 3, and the shorter the distance is, the less the transmission distortion will be. The distance between the rejective filter and the attenuator 8 in the travelling-wave tube amplifier according to the present invention is very short and the reflected higher harmonic components exist only in this short section, so that excellent frequency response characteristics, as exemplified in FIG. **4*b***, can be obtained.

Furthermore, in a communication system making use of a travelling-wave tube amplifier according to the present invention, the low-pass or band-pass filter 18 shown in FIG. 3 can be dispensed with. Since the power level required for the travelling-wave tube, and thus the d.c. power supplied to the travelling-wave tube, can be reduced by an amount equal to the insertion loss of the filter 18 in the external circuit, the overall power consumption of the apparatus can be reduced.

While detailed description of the invention has been made above in conjunction with helix type, metal envelope travelling-wave tube amplifiers having a coaxial feeder to waveguide transducer, the principle of the present invention is equally applicable to a structure in which a coaxial feeder terminal is itself connected to the coaxial line.

Although preferred embodiments of this invention has been described, many variations and modifications will now be apparent to those skilled in the art, and it is therefore preferred that the instant invention be limited not by the specific disclosure herein but only by the appended claims.

We claim:

1. A travelling-wave tube amplifier comprising a helix type travelling-wave tube including an electron gun for emitting and forming an electron beam, a collector for receiving said electron beam, a helix slow-wave circuit disposed between said electron gun and said collector and surrounding said electron beam for generating an electro-magnetic wave around said electron beam as excited by a high frequency signal applied to the end of said helix slow-wave circuit closest to said electron gun, an evacuated envelope receiving said electron gun, said collector and said slow-wave circuit, coaxial input and output terminals each consisting of an outer conductor hermetically connected to said envelope and a coaxial inner conductor insulated from its respective outer conductor and coupled to said slow-wave circuit, and coupling means connected to said coaxial output terminal of said travelling-wave tube for forming, in cooperation with said coaxial output terminal, a band-rejection filter for rejecting at least a portion of the second harmonic of the fundamental frequency inherent to said travelling-wave tube.

2. The travelling-wave tube amplifier of claim 1, wherein said coupling means comprises a waveguide transducer including a waveguide, a hollow cylindrical member disposed on a side wall of said waveguide and connected to said outer conductor of said output terminal; and a conductive member disposed coaxially with said hollow cylindrical member for exciting an electromagnetic wave within said waveguide.

3. The travelling-wave tube amplifier of claim 2, which includes an apertured circular end plate extending across the end of said hollow cylindrical member of said waveguide transducer; said outer conductor extending through said apertured circular end plate and extending into said hollow cylindrical member for a distance equal to about ¼ wavelength of said given harmonic, and a plate disc extending perpendicular from the axis of said inner conductor; said plate disc and said outer conductor being capacitively coupled.

4. The travelling-wave tube amplifier of claim 2, wherein said conductive member has a plurality of spaced, parallel disc plates mounted coaxially thereon at intervals selected to form a coaxial low-pass filter for rejecting said given harmonic.

5. The travelling-wave tube amplifier of claim 2, wherein a hollow cylindrical section having an inner diameter larger than that of said hollow cylindrical member and of said outer conductor is disposed between said hollow cylindrical member and said outer conductor; said inner diameter being selected to form a radial-line coaxial filter for rejecting said given harmonic.

6. The travelling-wave tube amplifier of claim 2, wherein said outer conductor is directly connected to said hollow cylindrical member, and a cup-shaped conductive member coaxially disposed relative to said inner conductor, and connected to said inner conductor and having a depth of about ¼ of the wavelength of said given harmonic.

7. The travelling-wave tube amplifier of claim 1, in which said coupling means comprises a coaxial line coupler.

8. In combination:

a helix type travelling-wave tube;

an attenuator connected to said helix type travelling-wave tube;

input and output terminals connected to opposite ends of said helix type travelling-wave tube;

an output circuit to be driven by the amplified output of said helix type travelling-wave tube;

a band-rejection filter circuit adapted to reject at least the second harmonic component of a signal to be applied to said output circuit by said travelling-wave tube;

said band-rejection filter being connected directly to said output terminal, and being connected between said output terminal and said output circuit.

9. The combination of claim 8, wherein said output terminal has a coaxial construction, and wherein said band-rejection filter comprises a waveguide transducer.

10. The combination of claim 9, wherein said band-rejection filter includes a plug-in connection means for plug-in connection to said output terminal.

* * * * *